US008696085B2

(12) United States Patent
Yamamoto

(10) Patent No.: US 8,696,085 B2
(45) Date of Patent: Apr. 15, 2014

(54) IMAGE RECORDING APPARATUS

(75) Inventor: Hideki Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 678 days.

(21) Appl. No.: 12/260,033

(22) Filed: Oct. 28, 2008

(65) Prior Publication Data

US 2009/0141314 A1 Jun. 4, 2009

(30) Foreign Application Priority Data

Nov. 30, 2007 (JP) ..... 2007-309662

(51) Int. Cl.
*B41J 29/393* (2006.01)
*B41J 2/21* (2006.01)
*B41J 2/045* (2006.01)

(52) U.S. Cl.
CPC ..... *B41J 2/2142* (2013.01); *B41J 2/04558* (2013.01)
USPC ..... 347/19

(58) Field of Classification Search
USPC ..... 347/19, 23
See application file for complete search history.

(56) References Cited

U.S. PATENT DOCUMENTS

| | | | | |
|---|---|---|---|---|
| 5,305,020 | A * | 4/1994 | Gibbons et al. | 347/177 |
| 5,570,451 | A * | 10/1996 | Sakaizawa et al. | 347/4 |
| 6,402,287 | B2 * | 6/2002 | Matsumoto et al. | 347/19 |
| 6,438,350 | B1 | 8/2002 | Hasegawa et al. | |
| 6,682,168 | B2 * | 1/2004 | Nakagawa et al. | 347/40 |
| 6,832,824 | B1 * | 12/2004 | Baker et al. | 347/19 |
| 7,334,859 | B2 | 2/2008 | Kojima | |
| 2005/0265749 | A1 | 12/2005 | Asanuma et al. | |
| 2007/0030300 | A1 * | 2/2007 | Jeong | 347/19 |
| 2007/0109386 | A1 * | 5/2007 | Mohri et al. | 347/104 |
| 2007/0263021 | A1 | 11/2007 | Tanaka et al. | |
| 2008/0111847 | A1 | 5/2008 | Kojima | |

FOREIGN PATENT DOCUMENTS

| | | | |
|---|---|---|---|
| JP | H09-301579 | A | 11/1997 |
| JP | 2000-344384 | A | 12/2000 |
| JP | 2004-136997 | A | 5/2004 |
| JP | 2005-199688 | A | 7/2005 |
| JP | 2006-140577 | A | 6/2006 |
| JP | 2006-143420 | A | 6/2006 |

(Continued)

OTHER PUBLICATIONS

Japan Patent Office, Notice of Reasons for Rejection for Japanese Patent Application No. 2007-309662 (counterpart to above-captioned patent application), mailed Jul. 12, 2011.

(Continued)

*Primary Examiner* — Julian Huffman
(74) *Attorney, Agent, or Firm* — Baker Botts L.L.P.

(57) ABSTRACT

An image recording apparatus includes a conveying mechanism configured to convey a recording medium in a conveying direction, and a recording unit configured to record an image on the recording medium conveyed by the conveying mechanism when the recording medium is in a first position below the recording unit. The apparatus also includes a discharge path in which the recording medium conveyed by the conveying mechanism is conveyed from the first position to a second position which is opposite the conveying mechanism and above the recording unit. Moreover, the apparatus includes a reading unit which faces the discharge path and is positioned on a side of the recording unit. The reading unit is configured to read the image recorded on the recording medium by the recording unit.

17 Claims, 5 Drawing Sheets

(56) References Cited

FOREIGN PATENT DOCUMENTS

| | | | |
|---|---|---|---|
| JP | 2006-305766 | A | 11/2006 |
| JP | 2007-301767 | A | 11/2007 |
| JP | 2008-049536 | A | 3/2008 |

OTHER PUBLICATIONS

Japan Patent Office, Decision to Grant a Patent for Japanese Patent Application No. 2007-309662 (counterpart to above-captioned patent application), mailed Oct. 11, 2011.

* cited by examiner

IMAGE RECORDING APPARATUS

BACKGROUND OF THE INVENTION

1. Field of the Invention The present invention relates generally to image recording apparatus which record images on recording media, and more particularly, to image recording apparatus which comprise a reading unit which reads a recorded image.

2. Description of the Related Art

In a known inkjet recording apparatus including a line head, a single nozzle is allocated for printing in a long and a narrow region in a conveying direction of a recording medium. Consequently, when a relatively small number of nozzles fail to eject ink, a particular line may not be recorded on the recording medium, or the particular line may be unevenly recording on the recording medium, thereby decreasing the quality of the image.

In another known inkjet recording apparatus, such as the inkjet recording apparatus described in Japanese Unexamined Patent Application Publication No. 2006-205742, a line image sensor is positioned at a position adjacent to a line head on the downstream side in a conveying direction. The line image sensor reads a test pattern recorded on a recording sheet. The line image sensor then may determine whether any nozzle in the line head failed to eject ink based on the recorded test pattern.

In yet another known inkjet recording apparatus which includes a line head, a discharge unit, which discharges recording sheet after an image is recorded on the recording sheet, is positioned above the line head. Consequently, the recording sheet on which the image is recorded is reversed, is conveyed in a direction opposite the conveying direction, and then is discharged. In such an inkjet recording apparatus, if an image sensor is positioned at a position adjacent to the line head on the downstream side in the conveying direction, as in the another known inkjet recording apparatus, the size of the apparatus may increase in the conveying direction.

SUMMARY OF THE INVENTION

Therefore, a need has arisen for image recording apparatus which overcome these and other shortcomings of the related art. A technical advance of the present invention is that a size of the image recording apparatus in the conveying direction may be decreased.

According to an embodiment of the present invention, an image recording apparatus comprises a conveying mechanism configured to convey a recording medium in a conveying direction, and a recording unit configured to record an image on the recording medium conveyed by the conveying mechanism when the recording medium is in a first position below the recording unit. The apparatus also comprises a discharge path in which the recording medium conveyed by the conveying mechanism is conveyed from the first position to a second position which is opposite the conveying mechanism and above the recording unit. Moreover, the apparatus comprises a reading unit which faces the discharge path and is positioned on a side of the recording unit. The reading unit is configured to read the image recorded on the recording medium by the recording unit.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-5, like numerals being used for like corresponding portions in the various drawings.

Figure 1:
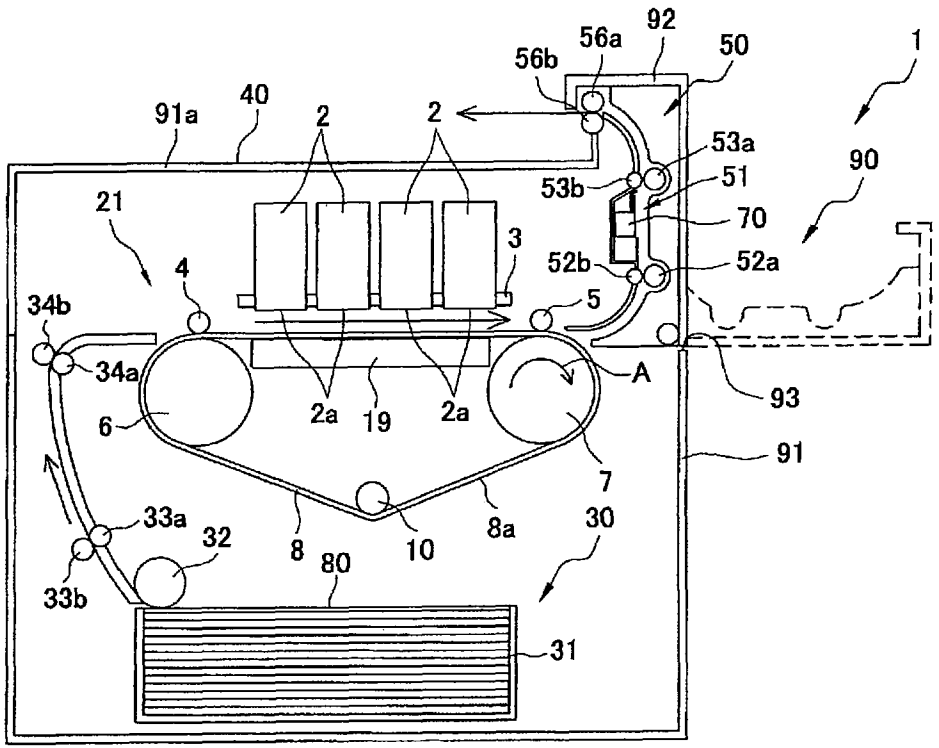
FIG. 1 is a schematic diagram of an inkjet printer, according to an embodiment of the present invention.

Referring to FIG. 1, an image recording apparatus, e.g., a printer, such as an inkjet printer 1, may comprise four inkjet heads 2. The inkjet heads 2 may be aligned in a conveying direction of a recording medium, e.g., a sheet 80, and may be fixed to a frame 3. The inkjet heads 2 each may have a shape elongated in a vertical direction in FIG. 1.

The printer 1 may comprise a feed unit 30, a conveying mechanism 21, a discharge path 50, and a discharge unit 40 aligned sequentially along a conveying path of the sheet 80. The printer 1 also may comprise a control unit 100 which controls operations of the units, such as the inkjet heads 2 and the feed unit 30, of the printer 1.

The feed unit 30 may comprise a sheet case 31 and a feed roller 32. The sheet case 31 may house a plurality of sheets 80. The feed roller 32 may feed, one by one, a top sheet 80 of the sheets 80 in the sheet case 31 to the conveying mechanism 21.

Two pairs of feed rollers 33*a* and 33*b*, and 34*a* and 34*b* may be positioned between the feed unit 30 and the conveying mechanism 21 along the conveying path of the sheet 80. The sheet 80 fed from the feed unit 30 may be guided by the pairs of feed rollers 33*a* and 33*b*, and 34*a* and 34*b*, and may be fed to the conveying mechanism 21.

The conveying mechanism 21 may comprise an endless conveying belt 8 and a pair of belt rollers 6 and 7. The conveying belt 8 may be wound between the belt rollers 6 and 7. A platen 19 may have a substantially rectangular parallelepiped shape, and may be positioned in a region surrounded by the conveying belt 8. The platen 19 supports the conveying belt 8 at a portion of the conveying belt 8 facing the inkjet heads 2 from an inner peripheral surface of the conveying belt 8. In addition, a tensile roller 10 may be positioned opposite the platen 19 in the region surrounded by the conveying belt 8. The tensile roller 10 may be urged in a direction away from the platen 19, e.g., downward in FIG. 1. As such, a tension with a predetermined magnitude may be applied to the conveying belt 8, such that the conveying direction of the conveying mechanism 21 for conveying the sheet 80 is straight.

The belt roller 7 may be connected to a conveyance motor 133. The conveying belt 8 moves when the conveyance motor 133 is driven to rotate the belt roller 7 in a direction indicated by an arrow A in FIG. 1. Then, the belt roller 6 may be rotated in association with the movement of the conveying belt 8.

A nip roller 4 may be position above the belt roller 6, such that the nip roller 4 nips the conveying belt 8 between the nip roller 4 and the belt roller 6. The nip roller 4 may be urged downward by a spring (not shown). The nip roller 4 may be configured to rotate in association with the movement of the conveying belt 8.

The sheet 80 fed from the feed unit 30 to the conveying mechanism 21 may be nipped between the nip roller 4 and the conveying belt 8. As such, the sheet 80 may be pressed to a conveying surface 8*a* of the conveying belt 8, and may be secured onto the conveying surface 8*a*. Then, the sheet 80 may be conveyed by the movement of the conveying belt 8 to a position at which the inkjet heads 2 are positioned. The conveying surface 8*a*, which may be an outer peripheral surface of the conveying belt 8, may comprise a sticky silicon rubber, such that the sheet 80 reliably may be secured onto the conveying surface 8*a*.

The four inkjet heads 2 may be positioned relatively close to each other in the conveying direction of the sheet 80. The four inkjet heads 2 each may comprise an ejection surfaces 2*a*. Each of the ejection surfaces 2*a* may comprise a plurality of nozzles (not shown) which are configured to eject ink droplets. The nozzles may eject ink of four different colors, such as magenta, yellow, cyan, and black. The inkjet heads 2 may be positioned, such that a slight gap is formed between the ejection surfaces 2*a* and the conveying surface 8*a* of the conveying belt 8.

The sheet 80 conveyed by the conveying belt 8 passes through the gap between the inkjet heads 2 and the conveying belt 8. At this time, the nozzles eject ink onto a recording surface 80*a* of sheet 80, which may be an upper surface of the sheet 80, and an image is recorded on the recording surface 80*a*.

A spur roller 5 may be positioned above the belt roller 7. When the conveyed sheet 80 on the conveying surface 8*a* is nipped by the spur roller 5 and the conveying belt 8, the sheet 80 additionally receives a conveying force, and may be discharged from the conveying mechanism 21.

The sheet 80 discharged from the conveying mechanism 21 may be separated by a separation plate (not shown), and then may be conveyed to the discharge path 50. The discharge path 50 may be formed between the conveying mechanism 21 and the discharge unit 40. The discharge path 50 may be a path for conveying the sheet 80 conveyed through the conveying mechanism 21, in a direction opposite the conveying direction. An upper surface of an upper wall 91*a* of a main body 91 may correspond to the discharge unit 40. The sheet 80 discharged from the conveying mechanism 21 may be discharged to the discharge unit 40 through the discharge path 50 in a U-turn manner.

A portion of the discharge path 50 may comprise a flat path 51 in a vertical direction. In the flat path 51, two pairs of conveying rollers 52*a* and 52*b*, and 53*a* and 53*b* may be positioned with a gap interposed between the two pairs, such that the gap is less than a width of the sheet 80 in the conveying direction. The sheet 80 discharged from the conveying mechanism 21 may be guided by the pairs of conveying rollers 52*a* and 52*b*, and 53*a* and 53*b*, and may be discharged to the discharge unit 40. Thus, sheets 80 on which an image is recorded sequentially may be discharged to the discharge unit 40, and then may be stacked on the discharge unit 40.

A reading unit, e.g., an image sensor 70, having a reading surface 70*a* may be positioned at the discharge path 50 adjacent to the inkjet head 2 and between the two pairs of conveying rollers 52*a* and 52*b*, and 53*a* and 53*b*. The reading surface 70*a* faces the flat path 51, such that the image sensor 70 captures and reads the image recorded on the recording surface 80*a* of the sheet 80 nipped by the two pairs of conveying rollers 52*a* and 52*b*, and 53*a* and 53*b*.

The image sensor 70 has an image pickup area extending in the vertical direction in FIG. 1, e.g., the Y direction, such that the image sensor 70 may be a line sensor. The image pickup area of the image sensor 70 may have a dimension equivalent to that of a printable area of the inkjet heads 2 in the Y direction. The image sensor 70 captures and reads the image recorded on the recording surface 80*a* of the sheet 80 to detect an ejection failure associated with a nozzle. The image sensor 70 may be positioned in an unused space of the discharge path 50 adjacent to the inkjet head 2. As such, the size of printer 1 in the conveying direction may be reduced.

Figure 2:
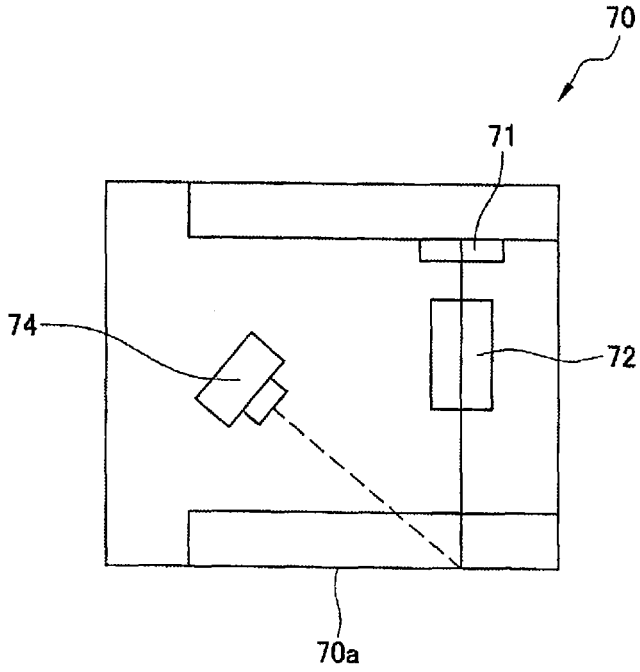
FIG. 2 is a cross-sectional view of an image sensor of the inkjet printer of FIG. 1, according to an embodiment of the present invention.

Referring to FIG. 2, the image sensor 70 may comprise an image pickup element 71, an imaging optical system 72, and a laser-emitting diode (LED) 74. The image pickup element 71 may be a contact image sensor (CIS), a charge-coupled apparatus (CCD), a complementary metal-oxide semiconductor apparatus (CMOS), or the like. The imaging optical system 72 may be positioned between the reading surface 70*a* (lower surface) and the image pickup element 71, to form an optical image of an object to be captured, e.g., the image recorded on the recording surface 80*a* of the sheet 80 conveyed by the conveying belt 8, onto the image pickup element 71. The LED 74 may be a source of light which is exited from the reading surface 70*a* and emitted on the object to be captured. The light emitted from the LED 74 may be reflected by the reading surface 70*a* and may be emitted on the object to be captured. The image pickup element 71, the imaging optical system 72, and the LED 74 may have shapes which are elongated in the Y direction.

In an embodiment of the present invention, a distance in a horizontal direction from the reading surface 70*a* of the image sensor 70 to the flat path 51 may be a predetermined distance selected, such that the optical image of the image recorded on the recording surface 80*a* may be formed onto the image pickup element 71 through the imaging optical system 72, i.e., image data which is obtained when the recording surface 80*a* of the sheet 80 conveyed through the flat path 51 is captured and read provides a focused image.

Referring again to FIG. 1, the four inkjet heads 2, the conveying mechanism 21, the discharge unit 40, the discharge path 50, and the image sensor 70 may be housed in a casing 90. The casing 90 may comprise a main body 91, and a door panel 92 rotatably supported by the main body 91. The main body 91 may have an opening 93 through which the discharge path 50 and the image sensor 70 are exposed to the outside. The door panel 92 may be configured to selectively cover the opening 93, as shown by a solid line in FIG. 1, and uncover the opening 93, as shown by a broken line in FIG. 1. As such, a recovery process, such as elimination of a paper jam or the like, in the discharge path 50, and a maintenance work of the image sensor 70, readily may be performed.

The sheet 80 conveyed through the discharge path 50 may be guided by a pair of feed rollers 56*a* and 56*b*, and may be discharged onto the upper surface of the upper wall 91*a* of the main body 91. The upper surface of the upper wall 91*a* of the main body 91 may be opposite the conveying mechanism 21 over the inkjet heads 2. The upper surface may correspond to the discharge unit 40.

When a printing operation is repeated while the image sensor 70 constantly faces the discharge path 50, paper dust or the like generated when the sheet 80 is conveyed through the discharge path 50 may adhere to the reading surface 70*a* of the image sensor 70. As such, when the image sensor 70 is not in the process of capturing an image, the image sensor 70 should be in a retracted position at which paper dust or the like do not adhere to the image sensor 70.

Figure 3B:
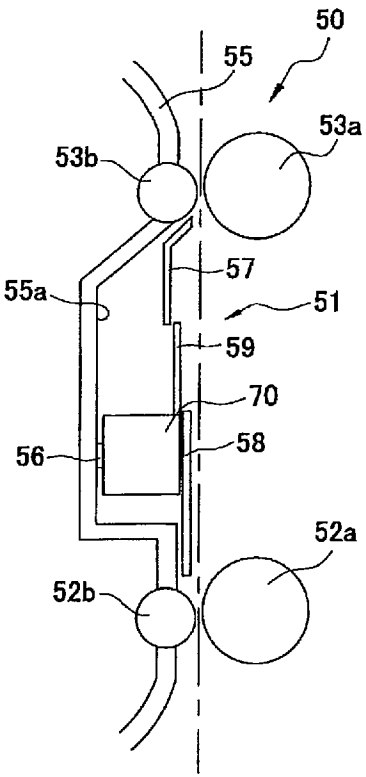
FIG. 3B is an enlarged view of the discharge path of the inkjet printer of FIG. 1, in which the image sensor is located at a retracted position.
Figure 3A:
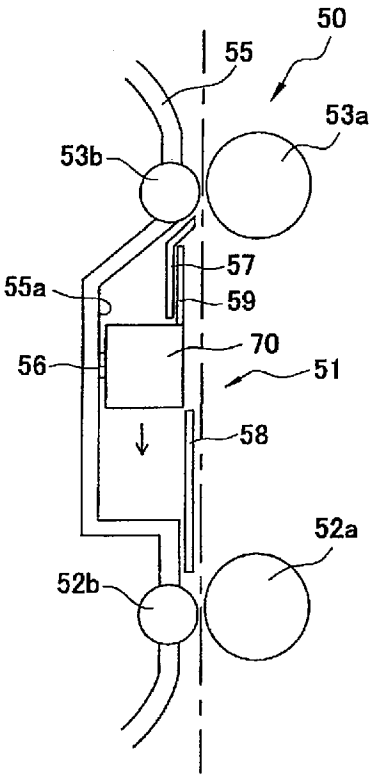
FIG. 3A is an enlarged view of a discharge path of the inkjet printer of FIG. 1, in which the image sensor of FIG. 2 is located at an image pickup position.

Referring to FIG. 3A, the conveying rollers 52*b* and 53*b* positioned at the discharge path 50 may be rotatably supported by a support member 55. The support member 55 may have a recessed shape in a direction away from the discharge path 50, defining a recessed portion 55*a*. The recessed portion 55*a* may have a groove with which a slide member 56 may be engaged. The slide member 56 may be slidable in the moving direction of the sheet 80. The image sensor 70 may be fixed to the slide member 56.

In addition, guide members 57 and 58 may be positioned between the two pairs of conveying rollers 52*a* and 52*b*, and 53*a* and 53*b* only at a portion of the discharge path 50. The guide members 57 and 58 guide the sheet 80, such that an intermediate region of the discharge path 50 is exposed.

As the slide member 56 slides under the control of a slide controller 104, the image sensor 70 is slidable between an image pickup position, as shown in FIG. 3A, located on the downstream side in the moving direction of the sheet 80, and a retracted position, as shown in FIG. 3B, located on the upstream side in the moving direction of the sheet 80.

When the image sensor 70 is at the image pickup position, the image sensor 70 faces the exposed region of the discharge path 50 where the guide members 57 and 58 are not positioned, and as such, the image sensor 70 may capture and read the image recorded on the recording surface 80*a* of the sheet 80. When the image sensor 70 is at the retracted position, which is on the side of the guide member 58 opposite the side facing the sheet 80, the image sensor 70 does not capture or read the image recorded on the recording surface 80*a* of the sheet 80.

A guide member 59 may be positioned on a side surface of the image sensor 70. The guide member 59 extends toward the downstream side in the movement direction of the sheet 80. The guide member 59 closes the exposed region of the discharge path 50 and guides the sheet 80 when the image sensor 70 is moved to the retracted position. As such, the sheet 80 may be prevented from deviating from the discharge path 50 whenever the image sensor 70 is located at the retracted position. Moreover, because the guide member 59 may be slidable together with the image sensor 70 in the movement direction of the sheet 80, the guide member 59 readily may be moved to the exposed region of the discharge path 50 when the image sensor 70 is located at the retracted position.

Figure 4:
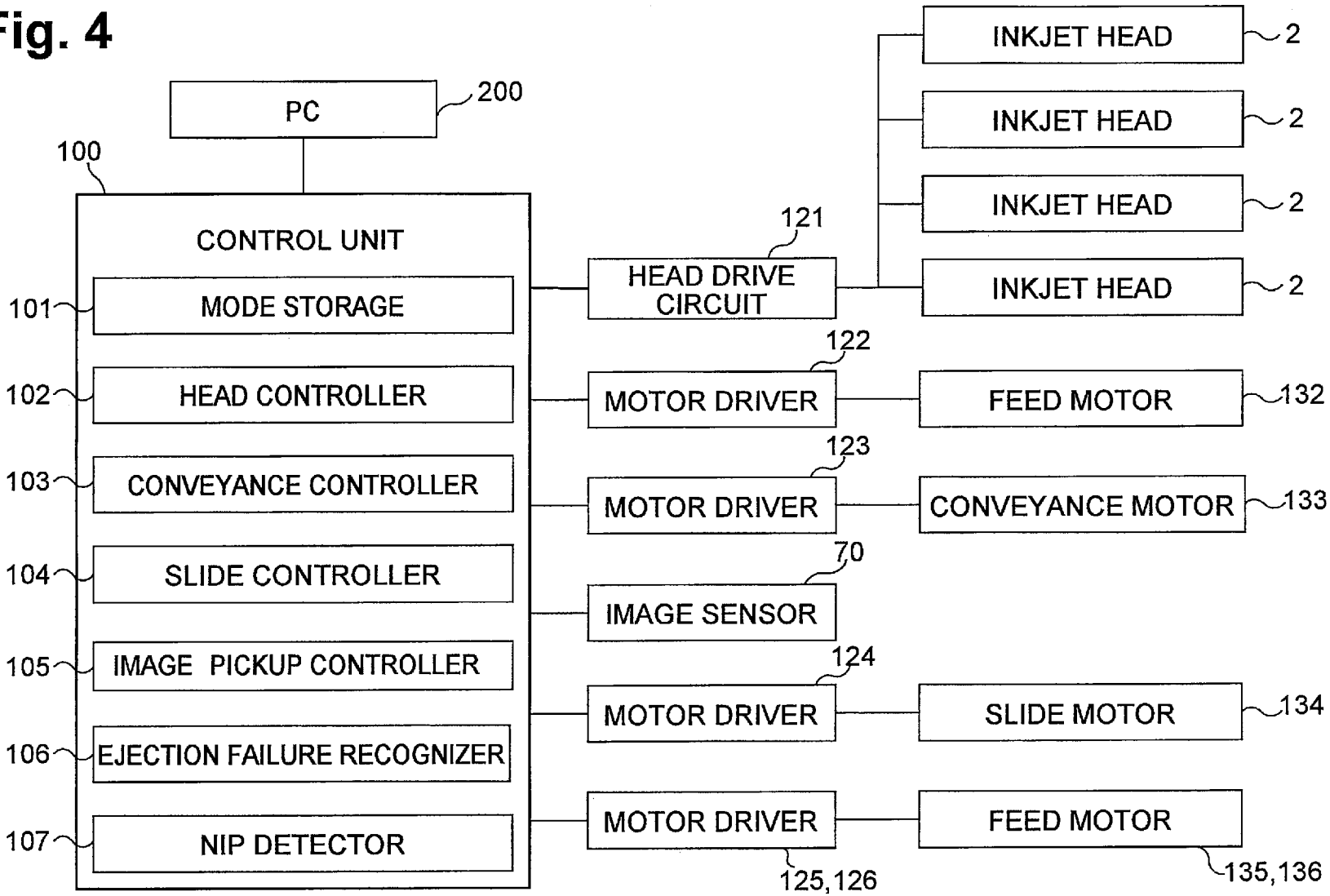
FIG. 4 is a block diagram of the inkjet printer of FIG. 1.

Referring to FIG. 4, the printer 1 may comprise a control unit 100 which controls various operations of the printer 1. The control unit 100 may comprise a central processing unit (CPU), a read-only memory (ROM) which stores a control program to be executed by the CPU and data to be used for the control program, and a random access memory (RAM) which temporarily stores data when the program is executed. In particular, the CPU, the ROM, and the RAM function as a mode storage 101, a head controller 102, a conveyance controller 103, a slide controller 104, e.g., a movement control means, an image pickup controller 105, an ejection failure recognizer 106, a nip detector 107, and the like.

The mode storage 101 stores information indicating whether the printer 1 is in a normal recording mode or an inspection mode. The normal recording mode is for printing an image desired by an operator on the sheet 80, and the inspection mode is for detecting an ejection failure of the image sensor 70 by capturing and reading the image recorded on the recording surface 80*a* of the sheet 80 conveyed by the conveying belt 8.

The inspection mode may be executed prior to the normal recording mode in which common print data is printed on multiple sheets 80. The stored content of the mode storage 101 automatically may be changed into the normal recording mode when the number of printing operations executed in the inspection mode exceeds a predetermined number of printing operations. Moreover, the stored content may be changed from the normal recording mode to the inspection mode or from the inspection mode to the normal recording mode when a personal computer (PC) 200 receives a signal through an operation by the operator. Alternatively, the mode storage 101 may be replaced with an analog circuit which outputs signals with different signal levels depending on the modes. For example, any type of mode indicating means for indicating the selected mode may be used.

The head controller 102 controls a head drive circuit 121, such that ink is ejected from the corresponding inkjet head 2 in accordance with print data received from the PC 200.

The conveyance controller 103 may be a rotation control means. Specifically, the conveyance controller 103 may control a motor driver 122, such that the feed roller 32 is rotated by driving of a feed motor 132, and thus, the top sheet 80 in the sheet case 31 is fed onto the conveying belt 8. Moreover, conveyance controller 103 may control a motor driver 123, such that the belt roller 7 is rotated by driving of a conveyance motor 133, and thus, the sheet 80 is conveyed while being held on the conveying surface 8*a* of the conveying belt 8. Further, the conveyance controller 103 may control motor drivers 125 and 126, such that a rotational speed of the conveying roller 53*a* located downstream of the image sensor 70 is greater than a rotational speed of the conveying roller 52*a* located upstream of the image sensor 70 by driving of feed motors 135 and 136.

In addition, the conveyance controller 103 controls the motor driver 123, such that the rotation of the belt roller 7 is stopped when the driving of the conveyance motor 133 is stopped after the sheet 80 on the conveying belt 8 reaches the discharge unit 40. When the printer 1 is in the inspection mode, the conveyance controller 103 performs similar control to that in the normal recording mode.

The slide controller 104 controls a motor driver 124, such that the slide member 56 slides by a driving of a slide motor 134, and thus, the image sensor 70 is moved to the image pickup position when the printer 1 is in the inspection mode and the nip detector 107 detects that the sheet 80 is nipped by the pair of conveying rollers 53*a* and 53*b*. Also, the slide controller 104 controls the motor driver 124, such that the slide member 56 slides by driving of the slide motor 134, and thus, the image sensor 70 is moved to the retracted position when the printer 1 is in the inspection mode and the nip detector 107 detects that the sheet 80 is released from the pair of conveying rollers 53*a* and 53*b*.

The image pickup controller 105 controls the image sensor 70, such that the image sensor 70 captures and reads the image on the recording surface 80*a* of the sheet 80 positioned on the conveying surface 8*a* when the printer 1 is in the inspection mode. The ejection failure recognizer 106 analyzes the image data obtained through the capturing.

The ejection failure recognizer 106 recognizes the presence of an ink ejection failure for each of the plurality of nozzles of the inkjet heads 2 based on a corresponding portion of an image of the image data obtained when the image sensor 70 captures and reads the recording surface 80*a* with the image printed thereon. In addition, the ejection failure recognizer 106 determines whether to perform a maintenance operation of the inkjet heads 2 based on the determined recognition. Herein, an ejection failure involves no ejection and variation in ejection amount. When the ejection failure recognizer 106 determines that the maintenance operation of the inkjet heads 2 should be performed, a maintenance unit (not shown) performs a recovery operation, such as a purge operation, to eliminate the ejection failure.

The nip detector 107 detects whether the sheet 80 is nipped by the two pairs of conveying rollers 52*a* and 52*b*, and 53*a* and 53*b*. For example, a detection method may comprise previously storing a first time from when print data is received from the PC 200 to when a sheet is nipped by the two pairs of conveying rollers 52*a* and 52*b*, and 53*a* and 53*b*, and a second time from when the print data is received from the PC 200 to when the sheet is released from the two pairs of conveying rollers 52*a* and 52*b*, and 53*a* and 53*b*. The detection method also may comprise counting a time after print data is received from the PC 200 with a timer (not shown) to detect the nipping.

Figure 5:
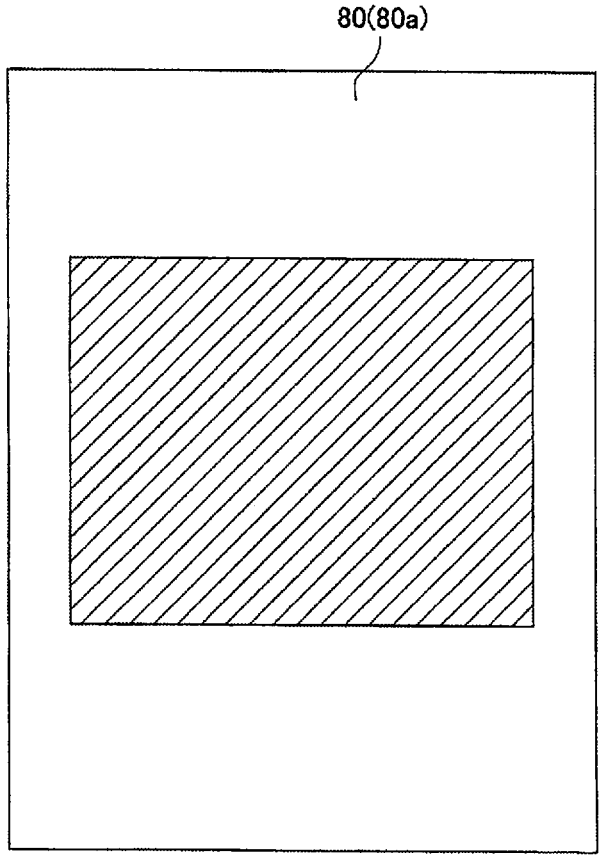
FIG. 5 is a plan view of a recording surface of a sheet.

Referring to FIG. 5, recording surface 80*a* of sheet 80 is depicted, in which the portion of recording surface 80*a* which has the image formed thereon is indicated by oblique lines.

In the inspection mode, the inkjet heads 2 record the image to be recognized by the ejection failure recognizer 106 in an area extending from a region of the sheet 80 facing the image sensor 70 when a leading edge of the sheet 80 is nipped by the pair of conveying rollers 53*a* and 53*b*, to a region of the sheet 80 facing the image sensor 70 when a trailing edge of the sheet 80 is nipped by the pair of conveying rollers 52*a* and 52*b*. As such, the ejection failure recognizer 106 may recognize the presence of the ejection failure of the inkjet heads 2 when the sheet 80 is nipped by the two pairs of conveying rollers 52*a* and 52*b*, and 53*a* and 53*b*. Thus, the sheet 80 may be prevented from being warped at an end portion thereof, contacting the image sensor 70, and contaminating the reading surface 70*a* of the image sensor 70. In addition, the ejection failure recognizer 106 accurately may recognize the presence of the ink ejection failure of the inkjet heads 2.

Referring to FIG. 3B, in the normal recording mode, the image sensor 70 constantly may be located at the retracted position. In the inspection mode, the image sensor 70 may be located at the retracted position until the nip detector 107 detects that the sheet 80 is nipped by the pair of conveying rollers 53*a* and 53*b*.

Referring to FIG. 3A, when the nip detector 107 detects that the sheet 80 is nipped by the pair of conveying rollers 53*a* and 53*b*, the image sensor 70 moves to the image pickup position, and begins capturing of the image on the recording surface 80*a* of the sheet 80. Thereafter, the image sensor 70 is located at the retracted position until the nip detector 107 detects that the sheet 80 is released from the pair of conveying rollers 52*a* and 52*b*. When the nip detector 107 detects that the sheet 80 is released from the pair of conveying rollers 52*a* and 52*b*, the image sensor 70 stops the capturing of the image, and is moved to the retracted position. Because the image sensor 70 is moved to the image pickup position only when the ejection failure recognizer 106 recognizes the presence of the ink ejection failure of the inkjet heads 2, paper dust or the like generated when the sheet 80 is conveyed through the discharge path 50 may not adhere to the image sensor 70.

As described above, the printer 1 may be reduced in size in the conveying direction by arranging the image sensor 70 in the unused space of the discharge path 50 adjacent to the inkjet head 2.

Moreover, because the image sensor 70 uses the image pickup controller 105 to capture and read the image on the recording surface 80*a* when the sheet 80 is located at the flat path 51, the ejection failure recognizer 106 accurately may recognize the presence of the ink ejection failure of the inkjet heads 2.

Further, because the sheet 80 is nipped by the two pairs of conveying rollers 52*a* and 52*b*, and 53*a* and 53*b* when the image pickup controller 105 controls the image sensor 70 to capture the image on the recording surface 80*a*, the sheet 80 may be prevented from being warped at an end portion thereof, contacting the image sensor 70, and contaminating the reading surface 70*a* of the image sensor 70.

In addition, because the rotational speed of the conveying roller 53*a* located downstream of the image sensor 70 may be greater than the rotational speed of the conveying roller 52*a* located upstream of the image sensor 70, the sheet 80 may be stretched while being nipped by the two pairs of conveying rollers 52*a* and 52*b*, and 53*a* and 53*b*. As such, the sheet 80 may be prevented from being warped, contacting the image sensor 70, and contaminating the reading surface 70*a* of the image sensor 70. Moreover, because the sheet 80 is stretched while being nipped by the two pairs of conveying rollers 52*a* and 52*b*, and 53*a* and 53*b*, the ejection failure recognizer 106 may further accurately recognize the presence of the ink ejection failure of the inkjet heads 2.

In another embodiment of the present invention, the door panel 92 may be omitted, and the opening 93 may be continuously in the uncovered condition. Alternatively, the opening 93 may be omitted.

In yet another embodiment of the present invention, the gap between the two pairs of conveying rollers 52*a* and 52*b*, and 53*a* and 53*b* may be less than the thickness of sheet 80, such that sheet 80 may be conveyed. Moreover, the rotational speed of the conveying rollers 52*a* and 53*a* may be equivalent to each other.

In still yet another embodiment of the present invention, the discharge path 50 may not be positioned with the flat path 51, and may have a semicircular shape.

In a further embodiment of the present invention, the retracted position to which the image sensor 70 is moved may be a position which is separated from the discharge path 50 and in which paper dust or the like generated when the sheet 80 is conveyed through the discharge path 50 do not adhere to the reading surface 70*a* of the image sensor 70.

In yet a further embodiment of the present invention, the guide members 57, 58, and 59 may be omitted.

In still yet a further embodiment of the present invention, sheet 80 may be replaced by a thin film or a metal foil which may be curved when being discharged in a U-turn manner.

In another embodiment of the present invention, the presence of the ink ejection failure may be recognized based on a color state of ink, such as that ink is discolored, instead of being recognized based on the corresponding portion of the image of the image data obtained when the image sensor 70 captures and reads the image.

In yet another embodiment of the present invention, the presence of a recording failure of an image recorded on the sheet 80 via a laser or the like may be recognized, i.e., the present invention may be applied to various types of image recording apparatus.

While the invention has been described in connection with embodiments, it will be understood by those of ordinary skill in the art that other variations and modifications of the embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. An image recording apparatus comprising:

a conveying mechanism configured to convey a recording medium in a conveying direction;

a recording unit configured to record an image on the recording medium conveyed by the conveying mechanism when the recording medium is in a first position below the recording unit;

a discharge path in which the recording medium conveyed by the conveying mechanism is conveyed from the first position to a second position which is opposite the conveying mechanism and above the recording unit; and a reading unit which faces the discharge path and is positioned at a side of the recording unit, wherein the reading unit is configured to read the image recorded on the recording medium by the recording unit;

a first pair of conveying rollers configured to vertically convey the recording medium from an upstream one of two curved portions, wherein the first pair of conveying rollers is disposed downstream of the upstream one of the two curved portions; and a second pair of conveying rollers configured to vertically convey the recording medium to a downstream one of the two curved portions, wherein the second pair of conveying rollers is disposed upstream of the downstream one of the two curved portions;

wherein the first pair of conveying rollers is positioned at the discharge path upstream of the reading unit;

wherein the second pair of conveying rollers is positioned at the discharge path downstream of the reading unit; and wherein the discharge path is U-shaped and comprises the two curved portions and a flat portion, which extends upward and is positioned between the two curved portions, and the reading unit is positioned at the flat portion, such that the reading unit is configured to read the image recorded on the recording medium when the recording medium is conveyed vertically in the flat portion of the discharge path.

2. The image recording apparatus of claim 1, further comprising a failure detector configured to detect an image forming failure associated with the image read by the reading unit based on a corresponding portion of image data captured by the reading unit.

3. The image recording apparatus of claim 2, wherein the failure detector compares the image data read by the reading unit with image data previously stored in a read only memory.

4. The image recording apparatus of claim 1, wherein the conveying direction for conveying the recording medium in the conveying mechanism is straight.

5. The image recording apparatus of claim 1, wherein a distance between the first pair of conveying rollers and the second pair of conveying rollers is less than a length of the recording medium in the conveying direction, wherein the recording unit records the image to be read by the reading unit in an area which ranges from a region of the recording medium facing the reading unit when a leading edge of the recording medium is nipped by the second pair of conveying rollers to a region of the recording medium facing the reading unit when a trailing edge of the recording medium is nipped by the first pair of conveying rollers.

6. The image recording apparatus of claim 5, further comprising a rotation controller configured to control a first rotational speed of the first pair of conveying rollers and a second rotation speed of the second pair of conveying rollers, wherein the second rotational speed is greater than the first rotational speed.

7. The image recording apparatus of claim 1, further comprising:

a recess portion in which the reading unit is positioned, the recess portion being adjacent to the discharge path; and a cover which covers the recess portion.

8. The image recording apparatus of claim 7, further comprising a moving mechanism configured to move the reading unit within the recess portion between a reading position at which the reading unit reads the image recorded on the recording medium, and a refracted position at which the reading unit is covered by the cover.

9. The image recording apparatus of claim 8, wherein the moving mechanism is configured to move the reading unit along the conveying direction in the recess portion.

10. The image recording apparatus of claim 9, wherein a part of the cover and the reading unit are integrally formed to move together.

11. The image recording apparatus of claim 7, wherein a portion of the cover is attached to the reading unit.

12. The image recording apparatus of claim 7, wherein the cover extends along the conveying direction in the recess portion.

13. The image recording apparatus of claim 1, wherein the reading unit comprises an image pickup element comprising a contact image sensor.

14. The image recording apparatus of claim 1, further comprising:

a casing which houses the conveying mechanism, the recording unit, the discharge path, and the reading unit therein, wherein the casing comprises:

a main body having an opening through which the discharge path and the reading unit are exposed; and a door panel supported by the main body, wherein the door panel is configured to selectively open and close the opening.

15. The image recording apparatus of claim 1, wherein the image recording apparatus is an inkjet printer.

16. The image recording apparatus of claim 1, wherein the discharge path curves upward immediately after the recording unit.

17. The image recording apparatus of claim 1, wherein the discharge path curves upward after the recording unit without curving downward.

* * * * *